US009840876B2

(12) United States Patent
Zhao et al.

(10) Patent No.: US 9,840,876 B2
(45) Date of Patent: Dec. 12, 2017

(54) POLYCRYSTALLINE DIAMOND COMPACT CUTTER

(71) Applicant: CNPC USA Corp., Houston, TX (US)

(72) Inventors: Liang Zhao, Spring, TX (US); Xiaomin Cheng, Houston, TX (US); Ning Li, Korla (CN)

(73) Assignee: CNPC USA Corp., Houston, TX (US)

( * ) Notice: Subject to any disclaimer, the term of this patent is extended or adjusted under 35 U.S.C. 154(b) by 217 days.

(21) Appl. No.: 14/875,234

(22) Filed: Oct. 5, 2015

(65) Prior Publication Data

US 2016/0097242 A1 Apr. 7, 2016

Related U.S. Application Data

(60) Provisional application No. 62/060,265, filed on Oct. 6, 2014.

(51) Int. Cl.
*E21B 10/573* (2006.01)
*C22C 26/00* (2006.01)

(52) U.S. Cl.
CPC ..... *E21B 10/573* (2013.01); *C22C 26/00* (2013.01)

(58) Field of Classification Search
CPC .. E21B 10/573; E21B 10/567; E21B 10/5735; C22C 26/00; C22C 2204/00; B22F 2005/001; Y10T 407/27
USPC ..... 175/374, 428, 432, 433, 434
See application file for complete search history.

(56) References Cited

U.S. PATENT DOCUMENTS

| | | | |
|---|---|---|---|
| 7,506,698 | B2 | 3/2009 | Eyre et al. |
| 7,517,589 | B2 | 4/2009 | Eyre et al. |
| 7,608,333 | B2 | 10/2009 | Eyre et al. |
| 7,712,553 | B2 | 5/2010 | Shamburger |
| 7,754,333 | B2 | 7/2010 | Eyre et al. |
| 7,972,395 | B1 | 7/2011 | Dadson |
| 8,197,936 | B2 | 6/2012 | Keshavan |
| 8,353,371 | B2 | 1/2013 | Cooley et al. |
| 8,567,531 | B2 | 10/2013 | Belnap et al. |
| 2007/0169419 | A1 | 7/2007 | Davis et al. |
| 2011/0003664 | A1 | 1/2011 | Maertz |
| 2011/0056141 | A1 | 3/2011 | Miess et al. |
| 2014/0069726 | A1 | 3/2014 | Mumma et al. |
| 2014/0166371 | A1 | 6/2014 | Whittaker |

*Primary Examiner* — Carib A Oquendo
(74) *Attorney, Agent, or Firm* — Andrew W. Chu; Craft Chu PLLC

(57) ABSTRACT

The polycrystalline diamond compact cutter includes a diamond table and a carbide substrate. Different zones of the diamond table with relative thermal stability and toughness to each other are arranged for a particular cutting efficiency and working life. A thermally stable zone has a metal formation agent removed and forms a top outer ring. A base zone bonds to the carbide substrate on the bottom surface of the diamond table. An anchor zone sets between the thermally stable zone and the base zone, and an absorbing zone extends from the top surface to the base zone. The absorbing zone is circumscribed by the thermally stable zone and the anchor zone. The weight percentage metal content of the anchor zone is less than weight percentage metal content of the base zone. The weight percentage metal content of the base zone is less than weight percentage metal content of the absorbing zone.

19 Claims, 4 Drawing Sheets

POLYCRYSTALLINE DIAMOND COMPACT CUTTER

CROSS-REFERENCE TO RELATED APPLICATIONS

The present application claims priority under 35 U.S.C. Section 119(e) from U.S. Provisional Patent Application Ser. No. 62/060,265, filed on 6 Oct. 2014, entitled "POLYCRYSTALLINE DIAMOND COMPACT CUTTER".

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OM MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to cutting elements on a drill bit. More particularly, the present invention relates to polycrystalline diamond compact cutters on a drill bit. Even more particularly, the present invention relates to polycrystalline diamond compact cutters having different zones of thermal stability and hardness.

2. Description of Related Art Including Information Disclosed Under 37 CFR 1.97 and 37 CFR 1.98

Polycrystalline diamond compact (PDC) cutters are used in drilling operations for oil and gas. Prior art drill bits were roller cone bits with multiple parts and rotating surfaces to grind through the rock formation. Newer drill bits were fixed-head bits, which were composed of a single part without any moving components. The fixed-head bits could be rotated by the drill string, so additional moving parts on the bit were not needed. Cutters attached to a fixed-head surface grind through a rock formation. The fixed cutters were more reliable under extreme heat and pressure conditions of the wellbore because there were no moving components. However, the wear on these cutters was substantial. The material composition of the cutters has evolved to extend the working life and to increase productivity of the cutters.

Diamond is the hardest material known, so cutters of diamond composition have been pursued. Bonding diamond to metal is a challenge, so the drill bits evolved from steel to composite materials, in particular, tungsten carbide. Tungsten carbide composite readily bonds to diamond. The basic prior art cutter is comprised of a diamond table made from diamond grit with a formation agent and a substrate of tungsten carbide. The formation agent is a metallic binder, usually cobalt. The diamond grit is sintered under high temperature and high pressure conditions, forming a layer bonded to the tungsten carbide or other substrate with the formation agent as a catalyst. The High Temperature-High Pressure (HT-HP) press can form the layer with a Cobalt or other Group VIII element as the catalyst, and the properties of the layer have been modified for various thicknesses, profiles, and patterns to affect the working life of the cutters. Alternatively, the diamond table can be sintered and removed from the substrate. The diamond table as a disk can undergo leaching for the removal of metal content, without the substrate. Then, the leached disk can be replaced on a substrate to form a cutter. The formation agent, such as a cobalt compound, is the binder in this formation of a cutter.

PDC cutters face additional problems, during drilling operations in the oil and gas industry. Down the wellbore, the drilling conditions are extreme. There can be excessive heat, over 750 degrees Celsius, which causes thermal expansion of the diamond-binder bond in the diamond table. The PDC cutter weakens when the binder expands and the diamond table is less stably mounted on the substrate. The diamond surface is more likely to become damaged or dislodged from the substrate. The PDC cutter is tough, but limited by thermal expansion problems.

The prior art has further modified PDC cutters, according to the limitations of the diamond-binder bond. For example, once sintered to the tungsten carbide substrate, the Cobalt binder can be removed from the diamond table in a process called "leaching". The PDC cutter lasts longer without as much thermal expansion, but the PDC cutter fractures more easily. Adjusting for the thermal stability, the PDC cutter loses toughness.

Various patents and patent applications disclose selective leaching to form layers of different thermal stability and toughness. Various shapes of the layers at various depths are also disclosed.

United States Publication No. 20140166371, published for Whittaker on Jun. 19, 2014, and United States Publication No. 20110056141, published for Miess, et al. on Mar. 10, 2011, both disclose methods for selective leaching. There can be a deep leach or a shallow leach. Masking can be used to set the layers so that the Cobalt or other binder can be removed at different rates and depths in the diamond table. Various shapes and patterns are disclosed as possible with this method. Besides masking, other additives can be added to form the desired pattern of leached diamond composite. United States Publication No. 20140069726, published for Mumma, et al. on Mar. 13, 2014, discloses a hydrophile additive.

Other patents disclose a particular arrangement of layers. U.S. Pat. No. 8,197,936, issued to Keshavan on Jun. 12, 2012, discloses a first thermally stable polycrystalline diamond layer, a second carbide substrate layer, and a third polycrystalline cubic boron nitride layer. The layers are in a particular configuration with the third layer surrounded by the first and second layer. U.S. Pat. No. 8,567,531, issued to Belnap et al on Oct. 29, 2013, covers an even more specific arrangement of layers and range of physical properties. U.S. Pat. No. 7,972,395, issued to Dadson on Mar. 13, 2014, discloses a system and method for processing a polycrystalline material with the specific recipe of the complexing agent.

It is an object of the present invention to provide a cutting element with thermal stability and toughness.

It is an object of the present invention to provide a cutting element with a balance of thermal stability and toughness in designated critical regions for extending the working life of the cutter.

It is another object of the present invention to provide a cutting element with a balance of thermal stability and toughness at a working edge of the cutting element to a worn edge of the cutting element.

It is an object of the present invention to provide a cutting element with a plurality of zones of different thermal stability and toughness.

It is another object of the present invention to provide a cutting element having zones of different metal content percentages.

It is still another object of the present invention to provide a cutting element having an arrangement of different metal content percentages in the diamond table.

It is an object of the present invention to provide a cutting element having an interrelationship of zones of different metal content percentages in the diamond table to affect working life.

It is an object of the present invention to provide a cutting element having an interrelationship of zones of different metal content percentages in the diamond table to account for cutting angle across the cutter.

It is an object of the present invention to provide a cutting element with a working life determined by wear resistance and impact resistance.

It is another object of the present invention to provide a cutting element with an interrelationship of zones of different metal content percentages in the diamond table setting wear resistance and impact resistance of the cutter.

These and other objectives and advantages of the present invention will become apparent from a reading of the attached specification.

BRIEF SUMMARY OF THE INVENTION

Embodiments of the polycrystalline diamond compact cutter of the present invention include a diamond table comprised of polycrystalline diamond particles and a formation agent, and a carbide substrate. The diamond table has a cylindrical profile with a top surface, a bottom surface, and a working edge around the top surface, and the carbide substrate bonds to the bottom surface of the diamond table. The formation agent is a metal compound, usually cobalt. The thermal stability and toughness of the cutter are balanced by selective leaching of different zones in the diamond table to set weight percentage metal content of each zone. The interrelationship of the zones extends working life of the cutter and effectiveness of the cutter.

There is a thermally stable zone comprising a first portion of the diamond table and forms at least a part of the top surface. There is a base zone comprising a second portion of the diamond table. The base zone bonds to the carbide substrate on the bottom surface. There is an anchor zone comprising a third portion of the diamond table. The anchor zone sets between the thermally stable zone and the base zone. There is also an absorbing zone comprising a fourth portion of the diamond table. The absorbing zone is circumscribed by thermally stable zone and anchor zone and extends from the top surface to the base zone. At least another part of the top surface is formed by the absorbing zone.

In embodiments of the invention, thermally stable zone extends over the anchor zone and down from the top surface so as to be adjacent to the base zone. The base zone attaches the anchor zone, the absorbing zone, and the thermally stable zone to the substrate. The thermally stable zone has a weight percentage metal content less than the anchor zone, the absorbing zone, and the base zone. The anchor zone has a weight percentage metal content less than the base zone, and the base zone has a weight percentage metal content less than the absorbing zone. The absorbing has a weight percentage metal content greater than the anchor zone, the absorbing zone, and the thermally stable zone. In some embodiments, the amount of difference in weight percentage metal content between zones is also balanced for thermal stability and toughness.

The arrangement and relative weight percentage metal content of the zones of the present invention balance thermal stability and toughness. The interrelationship between the zones also accounts for the position of the cutter against the formation to be cut and the relative wear on the cutter because of the angle of the cut and position relative to the formation. The working edge remains thermally stable and stronger to cut, even as the thermally stable zone is worn. The anchor zone adds toughness, while still remaining thermally stable enough to be effective as a working edge, when the cutter is worn. The absorbing zone has greater toughness to prevent breakage and release from the substrate, while the working edge progresses through the thermally stable zone and the anchor zone.

Embodiments of the present invention include the thermally stable zone extending downward from the top surface more than 500 micrometers. The thermally stable zone can also extend downward from the top surface less than or equal to 60% of a distance between the top surface and the bottom surface of the diamond table. In some embodiments, the thermally stable zone circumscribes the absorbing zone along the working edge, as a ring shape. As a ring shape, the ring is thick. The thermally stable zone can extend inward from the working edge at least 25% of a diameter of the diamond table.

The base zone forms the bottom surface of the diamond table, and the anchor zone circumscribes the absorbing zone. Similarly, the anchor zone can have a ring shape placed between the thermally stable zone and the base zone and around the absorbing zone. The anchor zone is a transition from the thermally stable efficient cutting of the thermally stable zone to the tougher base zone and absorbing zone.

Embodiments of the invention include the absorbing zone being centered over the base zone and surrounded by the thermally stable zone at the top surface. The absorbing zone is surrounded by the anchor zone beneath the top surface. The absorbing zone can abut the thermally stable zone at an inclined face, slanted downward from the top surface. The absorbing zone is a thick core of the cutter, ending before at least 25% of a diameter of the diamond table.

DETAILED DESCRIPTION OF THE INVENTION

Figure 1:
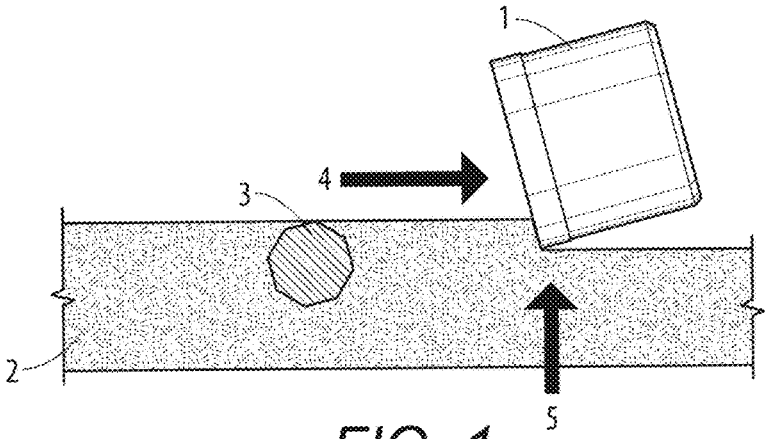
FIG. 1 is a schematic view of a cutter engaging a formation in a drilling operation.

In a drilling operation illustrated in FIG. 1, the cutter 1 slices through the formation 2. Various obstacles 3, such as minerals, ore, and impurities are interspersed throughout the formation 2. The cutter must power through to remove both formation 2 and obstacles 3. The cutter 1 experiences a lateral force 4 along the surface of the formation 2 and an upward force 5 perpendicular to the surface of the formation 2. The forces are not directly flush against a surface of the cutter 1, especially with obstacles 3 in the formation 2. The wear on the cutter 1 can also uneven across the surfaces of the cutter 1. The present invention is a cutting element to account for these variations by balancing thermal stability and toughness. The cutting element of the present invention is tough enough to cut through the formation and withstand the disruptive torsional forces trying to dislodge the cutting element from the bit. The relationship between the placement and relative weight percentage metal content of different zones in the present invention control thermal stability and toughness of the cutter or cutting elements so that zones are have resiliency and durability in different portions of the diamond table for an extended working life through actual drilling conditions.

Figure 2:
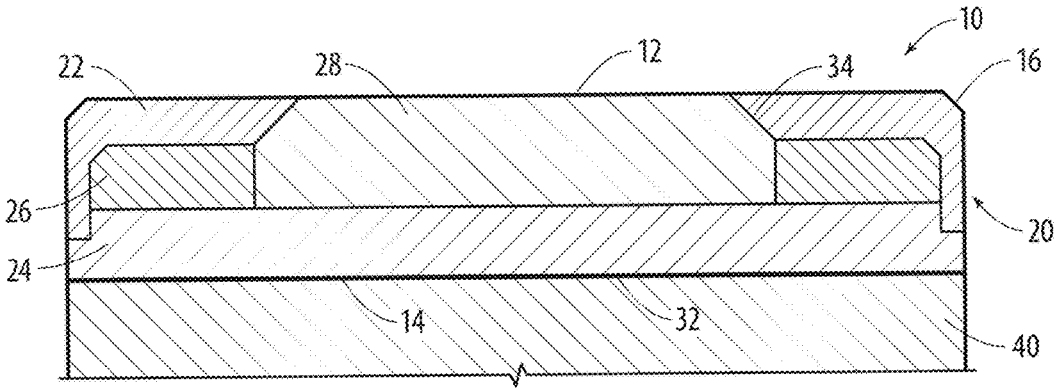
FIG. 2 is a schematic view of an embodiment of the cutter of the present invention.
Figure 3:
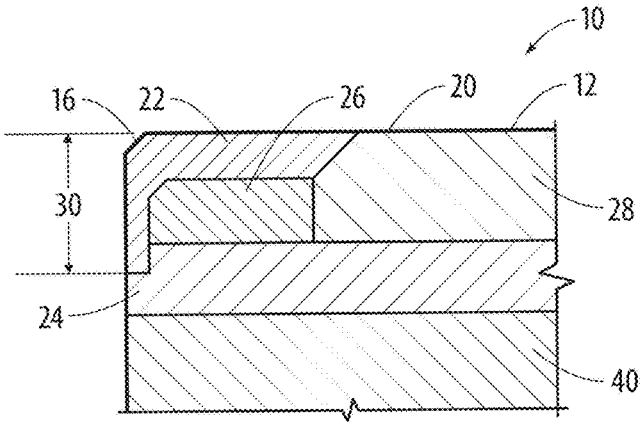
FIG. 3 is a partial sectional view of an embodiment of the cutter according to the present invention.

Referring to FIGS. 2-3, an embodiment of the polycrystalline diamond compact cutter 10 of the present invention is shown. The cutter 10 includes a diamond table 20 comprised of polycrystalline diamond particles and a formation agent, and a carbide substrate 40. The diamond table 20 has a cylindrical profile with a top surface 12, a bottom surface 14, and a working edge 16 around the top surface 12. The carbide substrate 40 bonds to the bottom surface 14. In some embodiments, the diamond table 20 is comprised of polycrystalline diamond particles and a formation agent, usually cobalt. The diamond particles bond to other diamond particles and the formation agent as a catalyst, during sintering to form the diamond table. The distribution of grain size of the diamond particles and the formation agent set the initial amounts of metal content. Alternatively, the formation agent can be a binder. A pre-formed diamond table disk, previously formed by sintering and previous leached for different layers of metal content, can be re-attached to a carbide substrate with the formation agent being a binder. A formation agent is a metal compound. When heat expands the formation agent, the bonds with the diamond particles can break, and the expanding formation agent can also break the bonds between diamond particles. The conventional formation agent as a binder or catalyst is comprised of metal, such as cobalt. The weight percentage metal content is an indicator of the amount of metal present.

The diamond table 20 is comprised of a first portion, second portion, third portion, and a fourth portion. Each portion corresponds to a zone. Thermal stability and toughness of the cutter 10 are balanced by selective leaching of different zones in the diamond table 20 to account for extending working life of the cutter 10 and effectiveness of the cutter 10 as positioned relative to the formation in an actual drilling operation. The selective leaching removes formation agent, in particular, the metal compound. The initial formation by distribution of grain size and the formation agent during sintering or initial formation with an alternate metal content can undergo selective leaching for physical properties and relative positions of the different zones enable the particular effectiveness and working life of the cutter 10 of the present invention.

FIGS. 2-3 show an embodiment of the diamond table 20 with a thermally stable zone 22 being comprised of a first portion of the diamond table 20 and forming at least a part of the top surface 12. There is a base zone 24, being comprised of a second portion of the diamond table 20 and bonding to the carbide substrate 40 on the bottom surface 14. There is an anchor zone 26, being comprised of a third portion of the diamond table 20 and being set between the thermally stable zone 22 and the base zone 24. There is also an absorbing zone 28, being comprised of a fourth portion of the diamond table 20. The absorbing zone 28 is surrounded by thermally stable zone 22 and anchor zone 26 and extends from the top surface 12 to the base zone 24. At least another part of the top surface 12 is formed by the absorbing zone 28. The thermally stable zone 22 extends over the anchor zone 26 and adjacent to the base zone 24 from the top surface 12. The base zone 24 attaches the anchor zone 26, the absorbing zone 28, and the thermally stable zone 22 to the carbide substrate 40.

According to embodiments of the invention, the thermally stable zone 22 has a weight percentage metal content less than the anchor zone 26, the absorbing zone 28, and the base zone 24. The thermally stable zone 22 has the least metal content for the most stable zone. There is less metal content so that the thermally stable zone 22 expands the least. With less metal, there is less expansion and breakage of links between diamond particles. The thermally stable zone 22 initial forms a working edge 16 of the diamond table 20 to cut the rock formation. The anchor zone 26 has a weight percentage metal content less than the base zone 24, and the base zone 24 has a weight percentage metal content less than the absorbing zone 28. The absorbing zone 28 has a weight percentage metal content greater than the anchor zone 26, the base zone 24, and the thermally stable zone 22.

Metal content is inversely related to thermal stability and directly related to toughness. With more metal content in the anchor zone 26 than the thermally stable zone 22, the diamond table 20 has an extended working life. The diamond table 20 retains the superior cutting of the thermally stable zone 22 for cutting efficiency, and the additional tough backing by the anchor zone 26 supports thermally stable zone 22 for this cutting efficiency. The absorbing zone 28 also supports the thermally stable zone 22 in an actual drilling orientation. The top surface 12 of the diamond table includes the thermally stable zone 22 and the absorbing zone 28, the least and most metal content. The cut angle of the diamond table 20 in the rock formation forms the working edge 16 only in the thermally stable zone 22, so that the least metal content is not needed across the entire top surface 12. The present invention balances the need for the cutting efficiency with the absorbing zone 28 having more metal content and more toughness to resist impacts. The top surface 12 is not uniform so as to account for fracture toughness and cutting efficiency.

Figure 4:
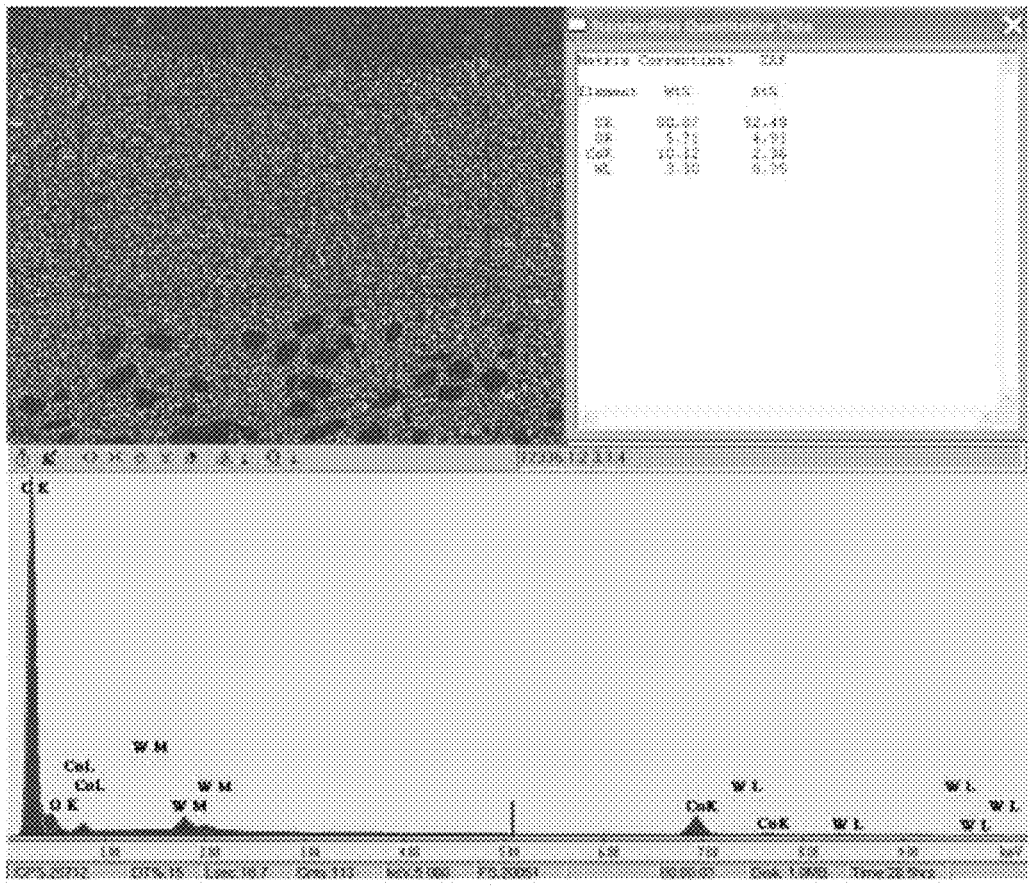
FIG. 4 is a photo representation of a scanning electron microscope in analysis of weight percentage metal content.
Figure 5:
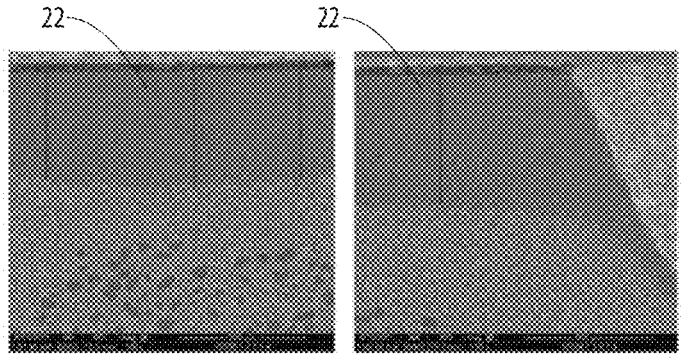
FIG. 5 shows other photo representations of a scanning electron microscope view of a thermally stable zone of the diamond table of the present invention.
Figure 6:
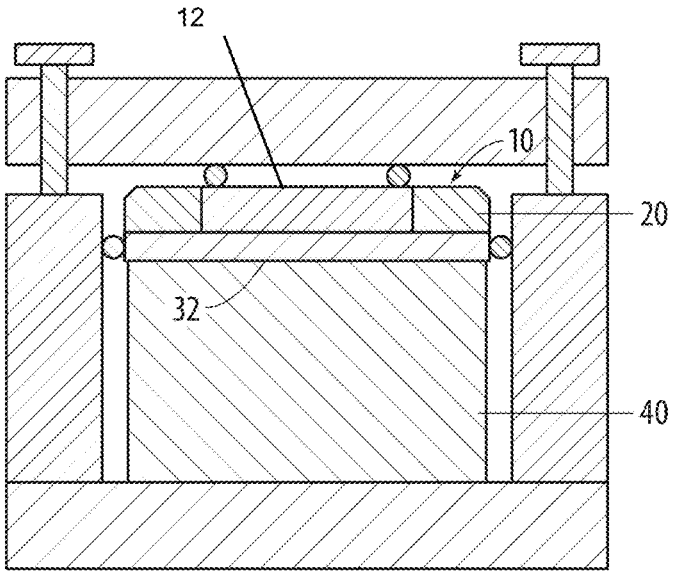
FIG. 6 is a schematic view of embodiment of a cutter being set for selective leaching to form zones of the present invention.

FIG. 4-6 show embodiments of the cutter 10 of the present invention. FIGS. 4 and 5 show measurement of the metal content percentage by Scanning Electron Microscope (SEM) to do EDAX analysis within diamond. The thermally stable zone 22 can be identified from FIG. 4 and mapped to the presentation in FIG. 5. The top dark layer in FIG. 5 represents the thermally stable zone 22. FIG. 6 shows the cutter 10 with the diamond table 20 and the carbide substrate 40 after sintering. Using grain size distribution, the metal content of the diamond table 20 is initially set. In some embodiments, the fourth portion to become the absorbing zone 28 has the most coarse and largest grains to hold the most metal content. The first and third portions to become the thermally stable zone 22 and the anchor zone 26 have the finest grains for the most effective cutting surface. FIG. 6 shows selective leaching to remove metal content from the first and third portions. The leaching process exposes the cutter 10 to a mixture of chemicals, most notably acid. The leaching activity the first and third portion and drips down to the second portion, which becomes the base zone 24. In some embodiments, the second portion also has finer grains, so that the weight percentage of metal content is initially set by sintering. Other techniques, such as laser removal or the formation agent as binder, can be used to set the zones 22, 24, 26, 28 of the diamond table 20. The cutter 10 of the present invention can be assembled with known techniques in the field of polycrystalline diamond compact cutters. Sintering with grain size distribution of the diamond particles and a metal formation agent as catalyst is one example.

For a sample cutter 10 of the present invention with Cobalt as the metal, EDAX analysis from a scanning electron microscope, according to FIGS. 4-5, shows one example of metal content percentage as:

TABLE 1

| Zone | Metal Content Percentage | Error |
|---|---|---|
| Anchor zone | Co 8.5% + W 2.5% | +/−1% |
| Base zone | Co 10.1% + W 3.3% | +/−1% |
| Absorbing zone | Co 10.5% + W 4.0% | +/−1% |

Figure 7:
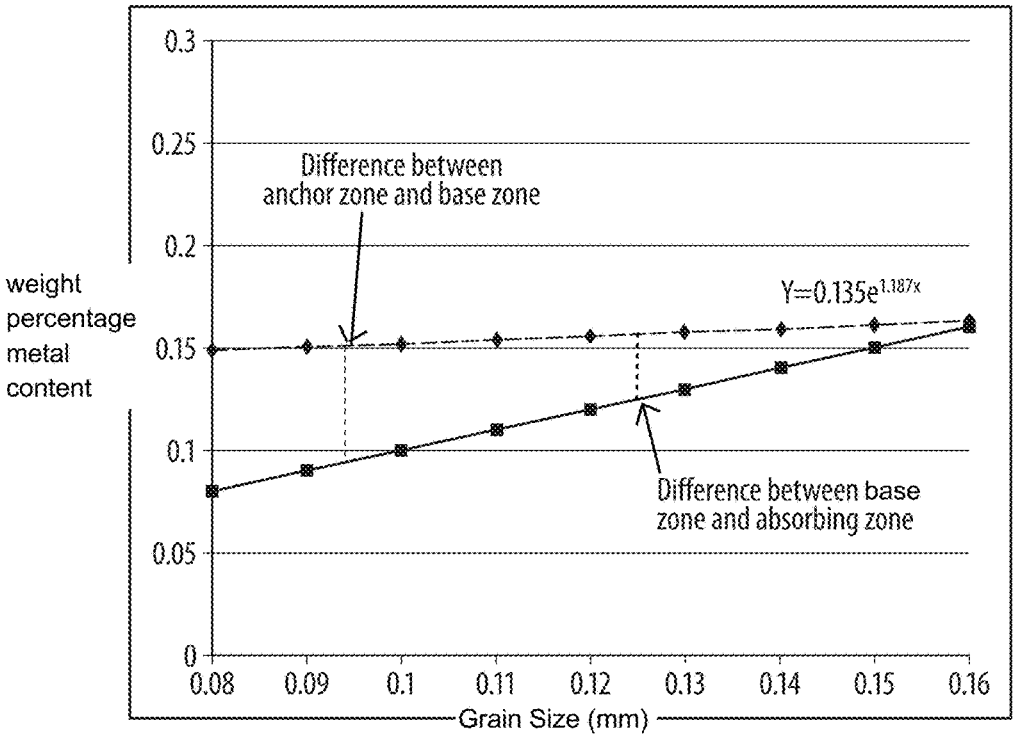
FIG. 7 is a graph illustration of the weight percentage metal content of zones of the cutter according to the present invention.

In the present invention, the amount of difference in weight percentage metal content can also be disclosed. The zones 22, 24, 26, 28 can be different, but not too different so that the zones 22, 24, 26, 28 remain interactive to achieve the extended working life. The entire diamond table 20 should remain attached to the carbide substrate 40, without individual zones 22, 24, 26, 28 breaking loose. In some embodiments, the base zone 24 has a weight percentage metal content less than or equal to $0.135e^{1.187x}$, wherein x is weight percentage metal content of the anchor zone 26. Also, the absorbing zone 28 has a weight percentage metal content less than or equal to $0.135e^{1.187y}$, wherein y is weight percentage metal content of the base zone 24. FIG. 7 shows weight percentage metal content according to grain size between two zones in a graph illustration. A zone can be identified by grain size from the sintering or other initial formation process. There is a linear approximation for a smooth gradient transition of the diamond grain size changes. In FIG. 7, the grain size of the absorbing zone 28 can be identified between 0.12 and 0.13, which relates to a weight percentage metal content. According to the invention, the weight percentage metal content of the base zone 24 must be selected within the range identified by the dotted line between 0.12 and 0.13. The grain size of the base zone 24 can be different, so the base zone 24 may need leaching to fit the desired relationship to the absorbing zone 28. Similarly, the grain size of the base zone 24 can be identified between 0.09 and 0.10, which relates to a weight percentage metal content. According to the invention, the weight percentage metal content of the anchor zone 26 must be selected within the range identified by the dotted line between 0.09 and 0.10.

In the embodiment of FIG. 7, the difference between the anchor zone 26 and the base zone 24 can be larger, while the difference between base zone 24 and the absorbing zone 28 can be smaller. The relationship prevents a thermal mismatch, which affects cutter performance. One zone expanding relative to another zone may affect the integrity of the diamond table 20 too much or dislodge the diamond table 20 from the carbide substrate 40. The toughness must stay within a range so that zones remain bonded to each other and the brittleness of the lower metal content is balanced by toughness.

The relative weight percentage metal content balances the base zone 24 to be tougher and less thermally stable than the absorbing zone 28 by a certain amount. The weight percentage metal content of the thermally stable zone 22 is less than any other zone. The thermally stable zone 22 is the least tough portion with little metal content, as needed for the working edge 16 of the cutter 10. The thermally stable zone 22 is the best cutting portion with high diamond content, but has less toughness. The thermally stable zone 22 may still wear and be less bonded to the substrate 40 without any binder catalyst. The other zones 24, 26 and 28 balance this "sharpest" portion of the cutter 10 with additional toughness to stay attached to the substrate 40.

The arrangement and relative weight percentage metal content of the zones of the present invention balance thermal stability and toughness. The arrangement and relationship between zones accounts for the position of the cutter against the formation to be cut and the relative wear on the cutter because of this angle and position relative to the formation. For wear, the working edge 16 moves across the thermally stable zone 22 on the top surface 12 and down toward the base zone 24 on the side. As the diamond table 20 wears, the anchor zone 26 can also start to form the working edge 16. The metal content of the anchor zone 26 remains sufficient for cutting efficiency and tougher to withstand impacts deeper into the cutter 10.

Embodiments of the present invention in FIGS. 2-3 include the thermally stable zone 22 extending downward from the top surface 12 more than 500 micrometers. The thermally stable zone can also extend downward from the top surface 12 less than or equal to 60% of a distance between the top surface 12 and the bottom surface 14 of the diamond table 20, as shown in FIG. 3. In some embodiments, the thermally stable zone 22 circumscribes the absorbing zone 28 along the working edge 16, as a ring shape. As a ring shape, the ring is thick. The thermally stable zone 22 can extend inward from the working edge 16 at least 25% of a diameter of the diamond table 20. The depth of the thermally stable zone 22 relative to the thickness of the diamond table 20 limits the cutting torque and prevents the diamond table 20 from dislodging from the substrate 40. A portion is a stable cutting surface, which may wear and be less stably attached. The other zones support and balance the toughness.

The base zone 24 forms the bottom surface 14 of the diamond table 20. The base zone 24 is bonded to the carbide substrate at seal 32 shown in FIGS. 2 and 6. The base zone 24 centers the diamond table 20 and can extend the full diameter of the carbide substrate. Impact energy to the top surface 12 of the diamond table is absorbed by the base zone 24 by axial vibration, when the impact energy is normal to the top surface 12. The base zone 24 remains adjacent or touching the three other zones. There can be a thickened area, which is also thermally stable. The base zone 24 prevents the diamond table 20 from dislodging from the substrate. In some cutting angles, a corner of the base zone 24 may cut the formation before engaging the anchor zone 26.

The anchor zone 26 circumscribes the absorbing zone 28. In some embodiments, the anchor zone 26 can have a compatible ring shape placed between the thermally stable zone 22 and the base zone 24, within the thermally stable zone 22 and around the absorbing zone 28. The anchor zone 26 is a transition from the thermally stable efficient cutting of the thermally stable zone 22 to the tougher base zone 24 and absorbing zone 28. If the thermally stable zone 22 is worn, cutting capability is maintained by the anchor zone 26. In the arrangement of the present invention, the position of the anchor zone 26 and thermally stable zone 22 relative to the base zone 24 and absorbing zone 28 allows effective cutting of the formation without loss of resilience and toughness of the base zone 24.

FIG. 3 shows the embodiment of the absorbing zone 28 being centered over the base zone 24 and surrounded by the thermally stable zone 22 at the top surface 12. The absorbing zone 28 can be surrounded by the anchor zone 26 beneath the top surface 12 too. The absorbing zone 28 abuts the thermally stable zone at an inclined face 34, slanted downward from the top surface 12. The absorbing zone 28 is a thick core of the cutter 10, ending before at least 25% of a diameter of the diamond table 20 and extending from the top surface to the base zone 24. The absorbing zone 28 is less thermally stable, but has greater toughness to withstand and absorb forces from drilling the formation. The torsional forces of the rotating bit against the formation are absorbed so that the diamond table 20 remains stably affixed to the substrate 40. The lateral force along the surface of the formation are also resisted and absorbed by the absorbing zone 28 at the top surface 12. The absorbing zone 28 balances the superior cutting ability of the thermally stable zone 22 at that top surface 12 for an effective arrangement accounting for actual position of the cutter 10 in a drilling operation.

Figure 8:
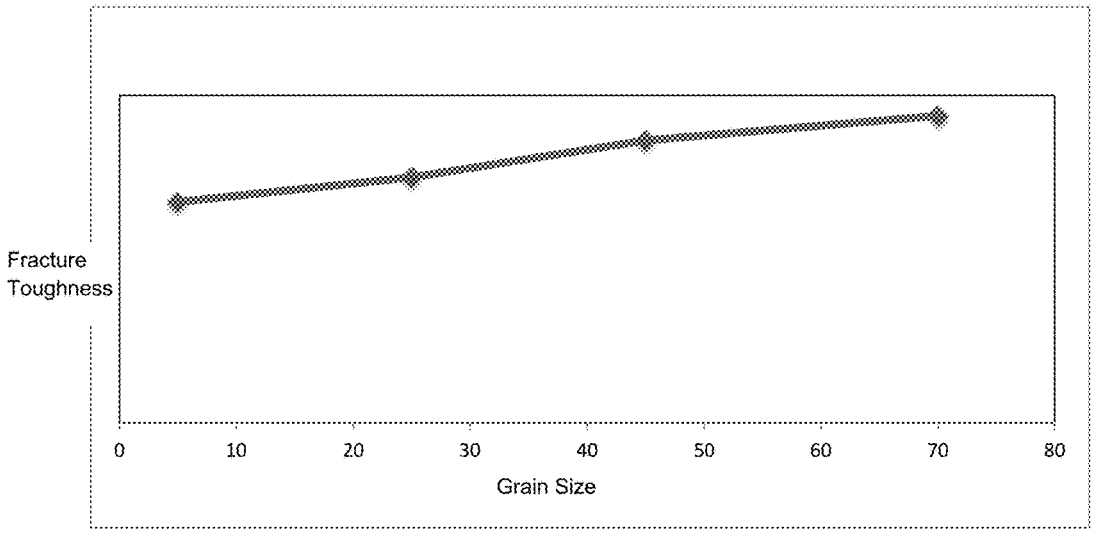
FIG. 8 is a graph illustration of fracture toughness as related to grain size of the cutter according to the present invention.

FIG. 8 shows fracture toughness related to grain size. From a sintered cutter, grain size can determine fracture toughness, as in the follow table:

| Grain Size | Fracture Toughness |
|---|---|
| 5 | 10.8 |
| 25 | 12 |
| 45 | 13.8 |
| 70 | 15 |

Without selective leaching, the cutter has portions set by the grain size of the diamond particles. The distribution of grain size relates to fracture toughness by the amount of metal content. As coarser particles hold more metal, these portions are tougher. In the present invention, the cutter forms portions with an interrelationship of thermal stability and toughness. Zones without the same grain size are adjusted for the actual cutting angle application and improved cutting efficiency and toughness. The present invention balances metal content of the zones of different grain sizes in a formation for extending working life of the cutter.

Figure 9:
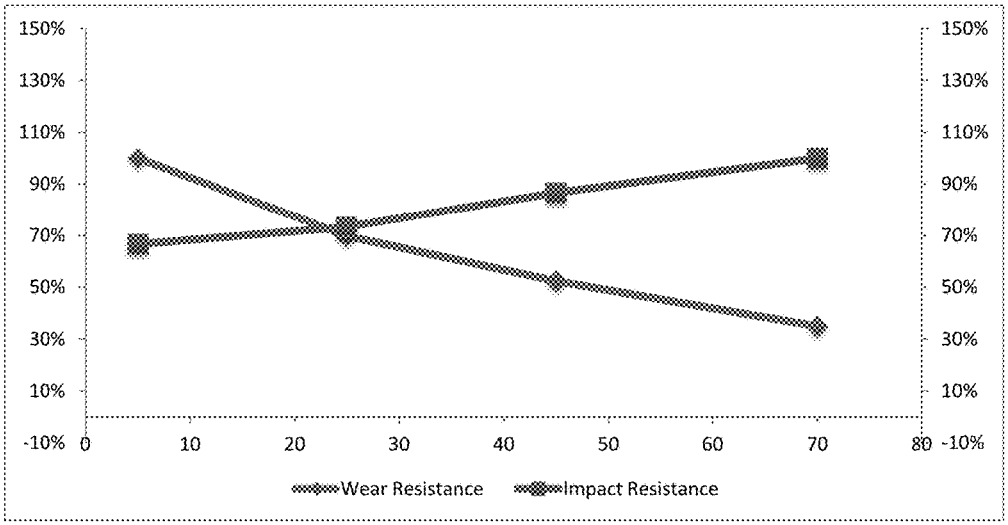
FIG. 9 is a graph illustration of the toughness as wear resistance and impact resistance of the cutter according to the present invention.

FIG. 9 shows a graph illustration of the working life of the cutter related to wear resistance and impact resistance. The data of the graph matches the table as follows:

| Grain Size | Wear Resistance | Impact Resistance |
|---|---|---|
| 5 | 100% | 67% |
| 25 | 70% | 73% |
| 45 | 52% | 87% |
| 70 | 35% | 100% |

The working life of the cutter 10 relates to wear resistance, which corresponds to less metal content, and impact resistance, which corresponds to fracture toughness. The thermally stable zone has the best cutting efficiency because there is the least metal content of all zones. The thermally stable zone as the cutting surface is not subject to much heat expansion due to the lack of metals. The remaining zones adjust according to the invention for a longer lasting cutter. Even with the same grains in the thermally stable zone and the anchor zone, the wear resistance and impact resistance are balanced to account for the cutting efficiency at an actual cutting angle and for extending the working life of the cutter. In the present invention, embodiments include a base zone of grain size between the thermally stable zone and the anchoring zone with a metal content to affect the relationship between the thermally stable zone, the anchor zone, and the absorbing zone. The differences on wear resistance and impact resistance of the present invention increase the working life of the cutter in the claimed relationship. The present invention moves beyond simply removing metal content to be more thermally stable and wear resistant. Each zone, relative placement of each zone, and the cutting angle contributes to the relationship between zones as claimed to extending working life of the cutter or cutting element.

Embodiments of the present invention provide a polycrystalline diamond compact cutter as a cutting element against a formation. The four zones of the diamond table of the cutting element interact with each other to balance of thermal stability and toughness in designated critical regions for extending the working life of the cutter. The pattern and relative thermal stabilities and toughness set a particular cutting efficiency and working life. The diamond table is balanced through the designated critical portions of the diamond table. The cutter of the present invention accounts for the actual position of the cutter relative to the formation and forces encountered from the formation. The working edge wears from the thermally stable zone to the anchor zone with different toughness. The working edge remains effective and attached was the amount of wear increases. The superior cutting ability of thermally stable diamond is balanced with toughness to remain intact and attached to the substrate. The best cutting surface is isolated at the working edge of the cutter and can move deeper into the cutter with adjusted toughness. The toughest portion is isolated at the center of the cutter. Forces to dislodge the diamond table from the substrate are countered by the arrangement of different zones with different relative weight percentage metal content.

Embodiments of the present invention include zones of different thermal stability and toughness. The zones can have different metal content percentages and an arrangement of different metal content percentages in the diamond table. The position and relative toughness of different metal content percentages in the diamond table to affect working life in actual drilling conditions with cutting across the cutter.

The working life determined by wear resistance and impact resistance is set by the relationship of the zones with different orientations relative to each other and different metal content percentages in the diamond table The foregoing disclosure and description of the invention is illustrative and explanatory thereof. Various changes in the details of the illustrated structures, construction and method can be made without departing from the true spirit of the invention.

We claim:

1. A polycrystalline diamond compact cutter, comprising:

a diamond table being comprised of polycrystalline diamond particles and a formation agent, the diamond particles being bonded to other diamond particles and said formation agent, said formation agent being a metal compound, said diamond table having a cylindrical profile with a top surface, a bottom surface, and a working edge around said top surface, said diamond table being comprised of a first portion, a second portion, a third portion, and a fourth portion; and a carbide substrate bonded to said bottom surface of said diamond table, wherein a thermally stable zone comprises said first portion of said diamond table, said thermally stable zone forming at least a part of said top surface so as to form said working edge, wherein a base zone comprises said second portion of said diamond table, being bonded to said carbide substrate on said bottom surface, wherein an anchor zone comprises said third portion of said diamond table, being positioned between said thermally stable zone and said base zone, wherein an absorbing zone comprises said fourth portion of said diamond table, being circumscribed by said thermally stable zone and said anchor zone, extending from said top surface to said base zone, and forming at least another part of said top surface, and wherein said thermally stable zone extends over said anchor zone and adjacent to said base zone from said top surface, said base zone attaching said anchor zone, said absorbing zone, and said thermally stable zone to said substrate, wherein said thermally stable zone has a weight percentage metal content less than said anchor zone, said absorbing zone, and said base zone, wherein said anchor zone has a weight percentage metal content less than said base zone, wherein said base zone has a weight percentage metal content less than said absorbing zone, and wherein said absorbing zone has a weight percentage metal content greater than said anchor zone, said base zone, and said thermally stable zone.

2. The polycrystalline diamond compact cutter, according to claim 1, wherein said base zone has a weight percentage metal content less than or equal to $0.135e^{1.187x}$, wherein x is weight percentage metal content of said anchor zone, and wherein said absorbing zone has a weight percentage metal content less than or equal to $0.135e^{1.187y}$, wherein y is weight percentage metal content of said base zone.

3. The polycrystalline diamond compact cutter, according to claim 1, wherein said thermally stable zone extends downward from said top surface more than 500 micrometers.

4. The polycrystalline diamond compact cutter, according to claim 1, wherein said thermally stable zone extends downward from said top surface less than or equal to 60% of a distance between said top surface and said bottom surface of said diamond table.

5. The polycrystalline diamond compact cutter, according to claim 1, wherein said thermally stable zone circumscribes said absorbing zone along said working edge, and wherein said thermally stable zone extends inward from said working edge at least 25% of a diameter of said diamond table.

6. The polycrystalline diamond compact cutter, according to claim 1, wherein said anchor zone has a ring shape, being placed between said thermally stable zone and said base zone and around said absorbing zone.

7. The polycrystalline diamond compact cutter, according to claim 1, wherein said absorbing zone is a centered over said base zone.

8. The polycrystalline diamond compact cutter, according to claim 1, wherein said absorbing zone is surrounded by said thermally stable zone at said top surface.

9. The polycrystalline diamond compact cutter, according to claim 1, wherein said absorbing zone abuts said thermally stable zone at an inclined face.

10. The polycrystalline diamond compact cutter, according to claim 9, wherein said inclined face slants downward from said top surface.

11. The polycrystalline diamond compact cutter, according to claim 1, wherein said absorbing zone is surrounded by said anchor zone beneath said top surface.

12. The polycrystalline diamond compact cutter, according to claim 1, wherein said absorbing zone ends before at least 25% of a diameter of said diamond table.

13. A polycrystalline diamond compact cutter, comprising:

a diamond table being comprised of polycrystalline diamond particles and a formation agent, the diamond particles being bonded to other diamond particles and said formation agent, said formation agent being a metal compound, said diamond table having a cylindrical profile with a top surface, a bottom surface, and a working edge around said top surface, said diamond table being comprised of a first portion, a second portion, a third portion, and a fourth portion; and a carbide substrate bonded to said bottom surface of said diamond table, wherein a thermally stable zone comprises said first portion of said diamond table, said thermally stable zone forming at least a part of said top surface so as to form said working edge, wherein a base zone comprises said second portion of said diamond table, being bonded to said carbide substrate on said bottom surface, wherein an anchor zone comprises said third portion of said diamond table, being positioned between said thermally stable zone and said base zone, wherein an absorbing zone comprises said fourth portion of said diamond table, being circumscribed by said thermally stable zone and said anchor zone, extending from said top surface to said base zone, and forming at least another part of said top surface, wherein said thermally stable zone has a weight percentage metal content less than said anchor zone, said absorbing zone, and said base zone, wherein said anchor zone has a weight percentage metal content less than said base zone, wherein said base zone has a weight percentage metal content less than said absorbing zone, and wherein said absorbing zone has a weight percentage metal content greater than said anchor zone, said base zone, and said thermally stable zone.

14. The polycrystalline diamond compact cutter, according to claim 13, wherein base zone has a weight percentage metal content less than or equal to $0.135e^{1.187x}$, wherein x is weight percentage metal content of said anchor zone, and wherein said absorbing zone has a weight percentage metal content less than or equal to $0.135e^{1.187y}$, wherein y is weight percentage metal content of said base zone.

15. The polycrystalline diamond compact cutter, according to claim 13, wherein said thermally stable zone extends over said anchor zone and adjacent to said base zone from said top surface, said base zone attaching said anchor zone, said absorbing zone, and said thermally stable zone to said substrate.

16. The polycrystalline diamond compact cutter, according to claim 15, wherein said anchor zone has a ring shape, being placed between said thermally stable zone and said base zone and around said absorbing zone.

17. The polycrystalline diamond compact cutter, according to claim 13, wherein said thermally stable zone circumscribes said absorbing zone along said working edge, and wherein said anchor zone circumscribes said absorbing zone, and wherein said absorbing zone is surrounded by said thermally stable zone at said top surface.

18. The polycrystalline diamond compact cutter, according to claim 13, wherein an amount of difference of weight percentage metal content between said base zone and said absorbing zone is greater than difference of weight percentage metal content between said base zone and said anchor zone.

19. The polycrystalline diamond compact cutter, according to claim 13, wherein said diamond table has a wear resistance increased by reducing metal content of each zone so as to extend working life of said cutting element.

* * * * *